United States Patent [19]

Taylor

[11] 4,368,747

[45] Jan. 18, 1983

[54] DISHWASHER

[76] Inventor: Frank J. P. Taylor, 18662 Mac Arthur Blvd., Irvine, Calif. 92715

[21] Appl. No.: 205,710

[22] Filed: Nov. 13, 1980

[51] Int. Cl.[3] ..... B08B 3/02

[52] U.S. Cl. ..... 134/93; 134/138; 134/141; 134/153; 134/200

[58] Field of Search ..... 134/93, 100–101, 134/138–139, 141, 153, 190, 200

[56] References Cited

U.S. PATENT DOCUMENTS

| | | | |
|---|---|---|---|
| 1,897,821 | 2/1933 | Poli | 134/93 |
| 1,907,269 | 5/1933 | Selmer | 134/139 |
| 1,915,162 | 6/1933 | Klaiber | 134/141 |
| 2,562,076 | 7/1951 | Weisselberg | 134/139 |
| 2,567,820 | 9/1951 | Messerschmidt | 134/138 |
| 3,469,586 | 9/1969 | Berson et al. | 134/93 |

FOREIGN PATENT DOCUMENTS

| | | | |
|---|---|---|---|
| 15250 | 1/1956 | Fed. Rep. of Germany | 134/153 |
| 2647356 | 5/1977 | Fed. Rep. of Germany | 134/138 |

*Primary Examiner*—Robert L. Bleutge
*Attorney, Agent, or Firm*—James E. Brunton

[57] ABSTRACT

A compact, portable, self-contained dishwasher adapted to be operably connected to a domestic hot water supply. The unit requires no auxillary power, relying solely upon water pressure for operation. The dishes and cookware to be washed are positioned upon a rotatable rack mounted within an upstanding housing. Water jets are directed at the rack to cause rotation thereof and to effectively accomplish the washing action. The water jets comprise a first collimated water jet adapted to initiate rotation of the rack and a second uniquely configured spray jet system adapted to sustain its action. A control valve is provided to control the flow of water through the collimated jet thereby enabling precise regulation of the speed of rotation of the rack. Also forming a part of the apparatus is a metering system for controllably mixing liquid soap or detergent with the water flowing into the jets.

12 Claims, 6 Drawing Figures

DISHWASHER

BACKGROUND OF THE INVENTION

1. Field of the Invention

The present invention relates generally to dishwashers and more particularly to a self-contained, portable dishwasher unit adapted to be removably interconnected with a domestic hot water supply.

2. Discussion of the Prior Art

Portable dishwashers operable solely by water pressure are not new. Several such units have been manufactured and sold in recent years. A common drawback of such units, however, has been their inability to rapidly and effectively clean dishes and cookware.

Many of the prior art units are cheaply constructed and have been sold more as a novelty item than as a bona fide, high performance dishwashing device. Generally, the washing action in such units is attempted by one or more rapidly rotating emitters located beneath or along side a rack holding the dishes. These emitters, which operate in much the same manner as lawn sprinklers have proven ineffective in the removal of most troublesome types of food residue on the dishes. Other types of emitters have from time to time been tried, but for the most part have also proven to be ineffective.

The apparatus of the present invention is not a toy, or a novelty item, but rather is a carefully engineered, high performance device adapted to rapidly and efficiently remove even the most difficult food residue from dishes and cookware. The uniquely designed and strategically positioned water jet means of the unit directs a multiplicity of high velocity water jets at the articles to be washed while they are rotated within the unit at an optimum rate of speed. These water jets impinge upon all the surfaces of the dishes supported within the rotating rack and create a unique scrubbing type of action which loosens and dislodges even the most difficult of residues. A unique dosing chamber precisely mixes an emulsifier, such as liquid soap, with the water upstream of the water jets thereby enhancing the cleaning efficiency of the device.

At the heart of the present invention is the uniquely configured water jet means. This means comprises a first collimated jet means adapted to initiate rotation of the rotatable rack which supports the dirty dishes, and a second spray jet means which accomplishes the scrubbing action and sustains the rotation of the rack. Control means are associated with the jet means whereby the rotational speed of the rack can be regulated to obtain maximum effectiveness. The spray jet means is strategically located with respect to the rack so that a multiplicity of fine, very high velocity water jets bombard the dishes from all angles from above, from below and from the sides. No prior art unit known to the present inventor utilizes this novel, unique and superior arrangement and accordingly no prior art device can equal or even approximate the cleaning efficiency of the device of the present invention.

SUMMARY OF THE INVENTION

It is an object of the present invention to provide a free standing, self-contained rotatable dishwasher for washing dishes, cookware and the like which is operated solely by domestic water pressure and can be directly connected to a hot water faucet of the type typically provided in kitchens and bathrooms of houses and apartments.

It is another object of the invention to provide a dishwasher of the aforementioned character in which in operation a multiplicity of very fine high velocity jets of water are directed at the articles to be washed from a multiplicity of directions, said jets being of such force as to quickly and efficiently dislodge and thoroughly clean even the most stubborn of food residues and greases.

It is another object of the invention to provide a dishwasher of the character described in which means are provided for uniformly and controllably mixing a soap or detergent with the high velocity water jets. This novel means is adapted to precisely meter the emulsifier into the water stream so as to economically use only the minimum amount of emulsifier necessary to effectively clean the dishes.

Still another object of the invention is to provide a dishwasher of the type described in the preceeding paragraphs in which the articles to be washed are strategically held in position upon a uniquely configured rotating rack adapted to orient the articles with respect to the high velocity water jets so as to achieve a novel scrubbing type of action to enable maximum cleaning in a minimum time.

Another object of the invention is to provide a dishwasher as described in the previous paragraph in which, during the start-up mode, a first collimated water jet is directed at the rotatable rack to initiate rotation. Once the starting inertia of the rack is overcome, the first water jet is closed, or partially closed, and the full force of the water is directed toward a jet spray system which sustains the rotation of the rack and at the same time effectively accomplishes the washing operation. By only partially closing the first water jet, the speed of rotation of the rack can be precisely regulated.

A further object of the invention is to provide a dishwasher of the class described which is compact, light weight, easily portable, highly attractive and extremely simple to use and maintain.

Still another object of the invention is to provide a dishwasher of the aforementioned character which can be readily interconnected to domestic water outlets without the use of special tools and which includes drain means for conveniently draining the unit into an existing kitchen or bathroom sink.

These and other objects of the invention are realized by a rotatable dishwasher comprising a housing, a rack rotatably mounted within the housing, the rack being adapted to support articles to be washed, jet means for directing a jet of water in the direction of said rack to impart rotational movement thereto, the jet means comprising a first collimated jet for emitting a collimated stream of water in the direction of the rack for initiating rotation thereof and a second spray jet for sustaining rotation of said rack, and dosing means adapted to cooperate with the second spray jet for dosing with soap water flowing through the second spray jet.

DESCRIPTION OF ONE FORM OF THE INVENTION

Figure 1:
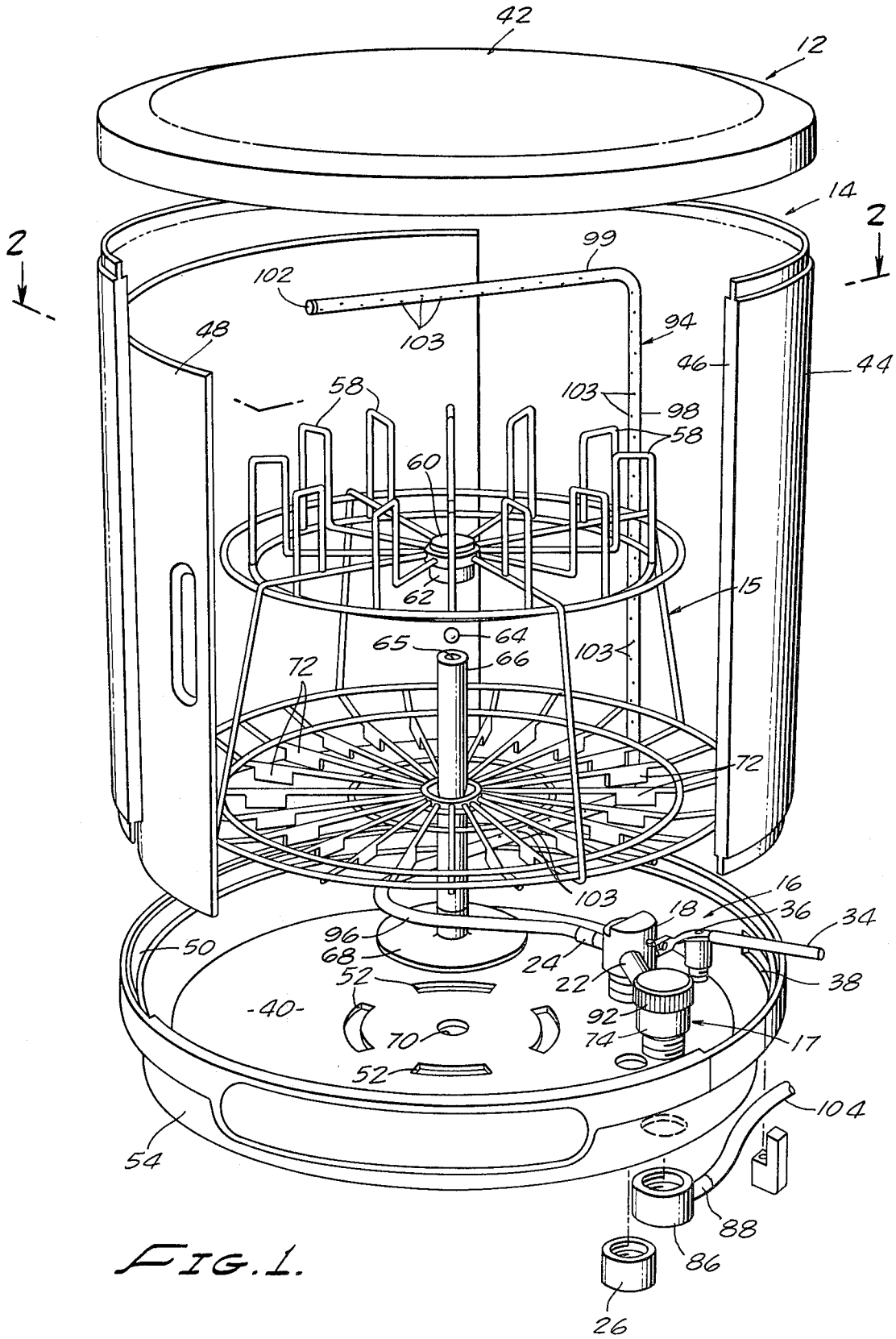
FIG. 1 is an exploded generally perspective view of the apparatus of the invention.
Figure 2:
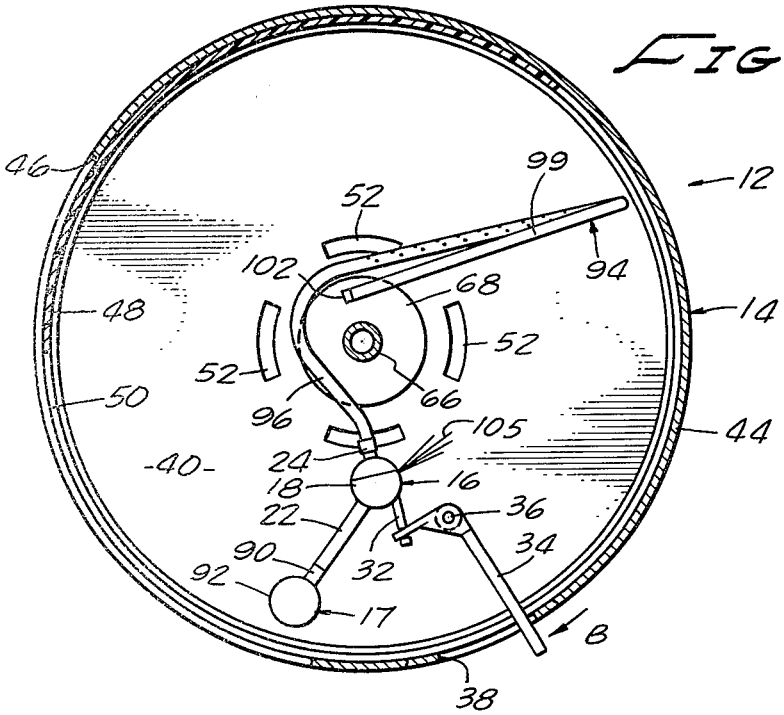
FIG. 2 is a cross-sectional view taken along lines 2—2 of FIG. 1, with the basket removed.

Referring now to the drawings and particularly to FIGS. 1 and 2, the dishwasher of the present invention, generally designated by the numeral 12, includes a housing 14, a rack 15 mounted for rotation within housing 14, jet means 16 for directing a jet of water at rack 14 to impart rotational movement thereto, and dosing means 17 adapted to cooperate with the jet means for dosing with an emulsifier water flowing through the jet means.

In the embodiment of the invention shown in the drawings, the jet means 16 comprises a first collimated jet means for directing a collimated stream of water at said rack for initiaing rotation thereof and a second spray jet means for sustaining rotation of the rack once the starting inertia of the rack has been overcome by the first jet. To control the rate of rotation of the rack, control means are provided. This control means is cooperatively associated with the first collimated jet means for controlling the rate of flow of the water therethrough, whereby the speed of the rotation of the rack can be controllably regulated.

Figure 3:
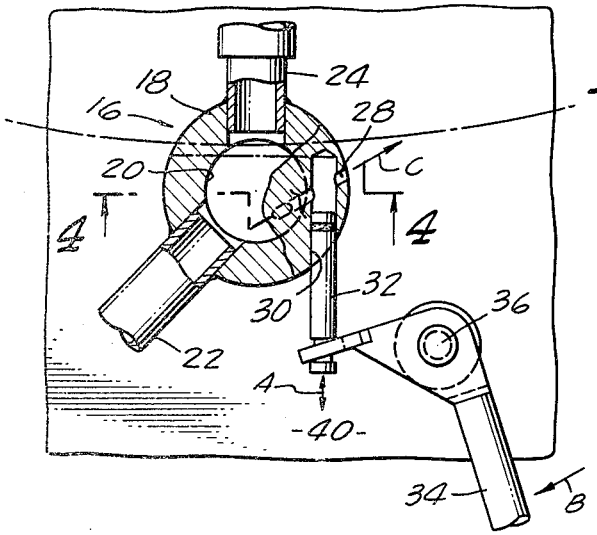
FIG. 3 is a fragmentary cross-sectional view of a portion of the jet means of the invention illustrating the construction and operation of the control means for controlling the first collimated jet means.
Figure 4:
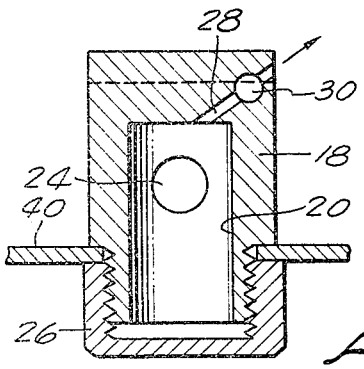
FIG. 4 is an elevational cross-sectional view taken along lines 4—4 of FIG. 3.

Referring now to FIGS. 3 and 4, the jet means 16 of the invention can be seen to comprise a cylindrically shaped housing 18 defining a chamber 20. Housing 18 has an inlet connection 22 (FIG. 1) leading into a chamber 20 and an outlet connection 24 leading from chamber 20. Housing 18 is provided with a threaded cap 26 which serves to close chamber 20 and, in a manner presently to be described, also functions to interconnect housing 18 with the floor of the dishwasher unit.

In the present form of the invention, the previously described first collimated jet means comprises an upwardly and outwardly inclined fluid passageway 28 extending through the wall of housing 18.

As best seen by referring to FIG. 3, a hole 30 is drilled in the wall of housing 18 so that it tangentially crosses passageway 28. Forming a part of the control means of the invention is a flow control needle 32 which is displaceable along the hole 30 in the direction indicated by the arrow A in FIG. 3. Movement of this flow control needle is effected by a lever 34 (FIG. 2) which is pivotally mounted at 36 on the floor of the dishwasher unit. Lever 34 protrudes through a slot 38 formed in the side wall of the unit. By displacing lever 34 in the direction of the arrow A in FIG. 2, the position of the needle 32 in the hole or passageway 30 can be precisely adjusted relative to passageway 28 to completely or partially block the flow of fluid through said passageway.

Referring once again to FIG. 1, housing 14 of the unit, which can suitably be constructed of thin plastic or sheet metal, comprises a circular floor 40, a circular roof 42 and a side wall 44 having an access opening 46. Although the dishwasher unit shown in the drawings is cylindrical in shape, the side wall 44 may be polygonal, having a large number of facets, say about 6 per quarter of its circumference; it may be eliptical; or for certain applications, it may be substantially rectangular in cross-section.

In the present form of the invention, closure means is provided in the form of a semi-cylindrically shaped member 48 movement of which is guided by a semi-circular rail portion 50 located in the region of the access opening 46. Closure member, or door, 48 may be constructed of a transparent plastic material, a light gauge sheet metal or any other suitably rigid composite material. To enable easy cleaning of the unit, the access opening 46 should be large enough to permit the rack 15 to be conveniently removed from the housing through the opening.

Floor 40 of the invention is provided with a plurality of drain openings 52 leading into a basin 54 secured beneath the floor 40. Basin 54 is provided with an outlet (not shown) which may be connected with a hose leading to a suitable domestic waste water drain.

The rack 15 is preferably of coated steel wire construction, and is provided with specially configured support elements 58 adapted to carry and strategically position various items of crockery, cutlery, dishes, and cookware and the like which are to be washed. Provided at the top of rack 15 is a bearing housing 60 which is of inverted cup shape and has a stainless steel bearing insert 62 therein (FIG. 1). In use, rack 15 rests with the insert 62 bearing on a stainless steel ball 64 so that the rack 15 can freely rotate about a vertical axis. Steel ball 64 is rotatably supported within a recess 65 provided at the top of a substantially vertically extending shaft 66 suitably interconnected to floor 40. Connected at the lower extremity of shaft 66 is a plastic ring 68 which is adapted to pressurally engage floor 40. The function of disc 68 is to take up any side thrusts imposed on shaft 66 resulting from asymmetrical loading of the rack 15. A centered aperture 70 is provided in floor 40 and is adapted to closely receive the lower end of shaft 66.

Provided at the bottom of the rack 15 is a plurality of radially extending vanes 72. Vanes 72 are strategically located so that as rack 15 rotates they will be impacted by the collimated stream of water emitted in the direction of arrow C (FIG. 3) by the first collimated jet means through the passageway 28 provided in the side wall of housing 18. As best seen by referring to FIG. 1, as rack 15 rotates about shaft 66, vanes 72 will be brought sequentially into a line with the collimated stream of water emitted through passageway 28. As previously mentioned, the force being exerted upon vanes 72 by this collimated stream of water can be controlled through operation of the needle valve 32 of the control means of the unit.

Figure 5:
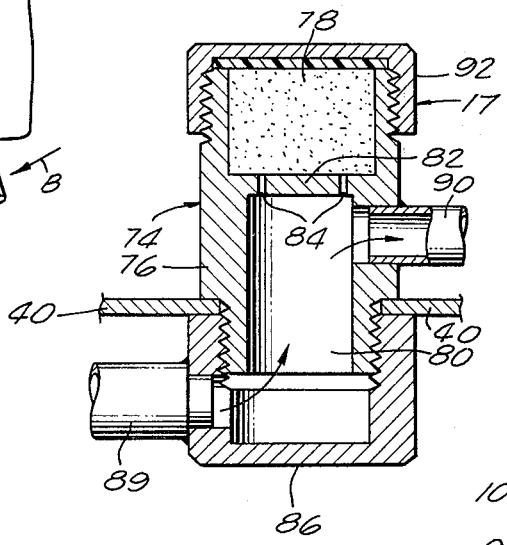
FIG. 5 is an elevational cross-sectional view of the dosing means of the invention showing the upper chamber adapted to receive the emulsifier and the cooperating lower chamber wherein the water and emulsifier is mixed.

Also forming a part of the apparatus of the present invention is the previously mentioned dosing means 17 which is adapted to cooperate with the jet means for dosing with an emulsifier water flowing through the jet means. In the present form of the invention, the dosing means comprises a housing 74, having a wall 76 (FIG. 5) and first and second interior chambers 78 and 80 which are divided by a partition 82. Chambers 78 and 80 are in communication with one another via two holes 84 extending through the partition 82. Chamber 80 is closed by an internally threaded cap 86 which also functions to secure the dosing means to the floor 40 of the unit. Cap 86 is provided with an inlet connection 88 leading toward lower chamber 80. An outlet connection 90 leads from the lower chamber 80 and is connected to the inlet connection 22 of housing 18 of the jet means. Chamber 78 is similarly closed by a removable, internally threaded cap 92.

In the present embodiment of the invention, the previously identified second spray jet means is provided in the form of a specially configured hollow tubing 94 (FIG. 2). Tubing 94 has a first substantially horizontal extending leg portion 96 extending beneath rack 15, a substantially vertically extending leg portion 98 (FIG. 1) disposed proximate the periphery of rack 15, and a second substantially horizontally extending leg portion 99 disposed above rack 15. Tubing 94 may be constructed from copper, aluminium, plastic or other suitable durable material which can be bent into the configuration shown in FIGS. 1 and 2. The first horizontally extending portion 56 of the tubing 94 is connected to the outlet connection 24 of housing 18 and the upper end 102 thereof is closed.

Figure 6:
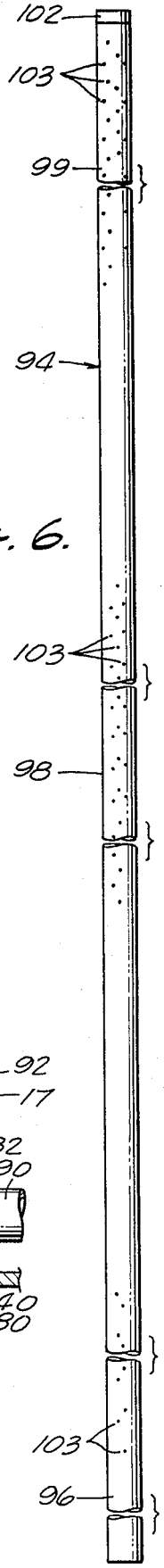
FIG. 6 is a foreshortened plan view showing the uniquely apertured tubing which comprises the second spray jet means of the apparatus. In this view the tubing is shown as it appears prior to being formed into the special configuration illustrated in FIGS. 1 and 2.

Referring to FIG. 6 it can be seen that a multiplicity of small holes 103 are drilled in a specific pattern in each of the leg portions as well as in the vertically extending portion of the tubing 96. The pattern of holes 103 is carefully engineered to create a three dimensional water spray pattern within housing 14 which sustains rotation of rack 15 and produces a unique scrubbing type of cleansing action on the dishes and cookware supported in rack 15. In FIG. 6 which shows the tubing 94 as it appears prior to being bent, the precise drilling hole pattern is clearly illustrated. For the reasons previously discussed, the position of these holes or apertures 103 is critical to the operation of the device in that through each aperture there is directed a high velocity spray jet which impinges on the articles to be washed. The velocity of these jets coupled with the three dimensional pattern thereof creates a highly novel and unique scrubbing action upon the articles supported within rack 15.

In using the dishwasher of the invention, the articles to be washed are placed on the rack 15, a quantity of emulsifier such as liquid soap, detergent or other cleansing material is charged into the upper compartment 78 of the dosing means by removal of cap 92 and a household hot water supply is connected to the inlet connection to the unit 104 (FIG. 1). Water enters the lower compartment 80 and leaves it again via the connection 90 from where it enters chamber 20 via connection 22. During the start-up mode, a portion of the water issues via the hole 28 in the form of a collimated stream or jet, which has previously been discussed, is directed at the vanes 72. The correct angular orientation of passageway 28 with respect to vanes 72 is fixed due to the manner in which housing 18 is secured to floor 40 by means of the threaded cap 26 (see FIG. 4). Impingement of the jet or collimated stream of water 105 (FIG. 2) against the surfaces of the vanes causes the rack 15 to rotate carrying the articles to be washed along with it. The remainder of the water enters tube 94 via connection 24 and issues from the apertures 103 in the form of a multiplicity of high velocity, multi-dimensional water sprays adapted to impinge upon the articles carried by the rack 15.

During the washing operation, the emulsifier contained in the upper compartment 78 of the dosing means is precisely metered through the openings 84 of partition 82 into the lower compartment 80 where it is uniformly mixed with the water entering the inlet connection 90.

Once the at rest inertia of the rack is overcome and rotation has commenced, the lever 34 may be adjusted to completely or partially close passageway 28 thereby either stopping, or, if desired, regulating, the force of the collimated stream of water eminating therefrom. In this way, the speed of the rack may be adjusted simply by adjusting the position of lever 34. It is to be understood, however, that even with passageway 28 completely closed, the rack will continue to rotate due to the force of the spray jets eminating from the tube 94. If, however, acceleration of rotation of the rack is desired for any purpose, this may be achieved through adjustment of the lever 34.

In operation, as the water sprays are emitted from tube 94 and impinge on the articles to be washed, the bottom portion of the unit will partially fill with water. In view of the fact that the vanes 72 extend downwardly a substantial distance, the water build-up in the base of the unit will tend to controllably impede the rotation of the rack as vanes 72 move through the water build-up. During normal operation the arrangement of the unit and the size of drains 52 is such that the water level in the base of the unit will stabalize at a point to maintain a sufficient level of water within the base of the housing to dampen rotation of the rack 15 and prevent an undesirably high speed of rotation thereof.

If it is desired to completely clean the unit, the rack 15 can be raised in the manner shown in FIG. 1 and removed through the access opening 46 in the housing 14. The interior of the housing as well as the rack can then be thoroughly cleaned.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A rotatable dishwasher, comprising:

(a) a housing;

(b) a rack rotatably mounted within said housing, said rack being adapted to support articles to be washed;

(c) jet means for directing a jet of water in the direction of said rack to impart rotational movement thereto, said jet means comprising:

(i) a first collimated jet means for emitting a collimated stream of water in the direction of said rack for initiating rotation of said rack; and (ii) a second non-rotatable spray jet means for sustaining rotation of said rack; and (iii) control means for controllably and simultaneously regulating the flow of water between said first collimated jet means and said second spray jet means whereby the force of the stream of water directed at said rack can be controllably decreased after rotation of said rack is initiated while the force of the water eminating from said spray jet means is correspondingly increased thereby sustaining uniform rotation of said rack;

(d) dosing means adapted to cooperate with said second spray jet means for dosing with soap water flowing through said second spray jet means.

2. A rotatable dishwasher as defined in claim 1 in which said rack is provided with a plurality of spaced apart vanes, said vanes being positioned so as to be impacted by the collimated stream of water emitted by said first jet means.

3. A rotatable dishwasher as defined in claim 2 including means for providing a bath of water within which said vanes are at least partially immersible for dampening rotation of said rack.

4. A rotatable dishwasher as defined in claim 1 in which said housing is substantially circular in cross-section at any point and comprises a floor, a roof and a side wall having a closable access opening.

5. A rotatable dishwasher as defined in claim 1 in which said second spray jet means comprises a hollow tubing having a lower horizontal leg portion, a vertically extending portion and an upper horizontal leg portion, each of said leg portions and said vertically extending portion having a multiplicity of apertures therein adapted to emit water under pressure in a direction toward said rack.

6. A rotatable dishwasher, comprising:

(a) a housing having a floor, a roof and a side wall providing an access opening therein;

(b) closure means for closing the access opening;

(c) a rack rotatably mounted within said housing, said rack being adapted to support articles to be washed and being provided with a plurality of spaced apart downwardly depending vanes;

(d) jet means for directing a jet of water in the direction of said rack to impart rotational movement thereto, said jet means comprising:

(i) a first collimated jet means for emitting a collimated stream of water in the direction of said vanes of said rack for initiating rotation of said rack;

(ii) a second spray jet means for sustaining rotation of said rack; and (iii) control means for simultaneously adjusting said first collimated jet means and said second spray jet means to regulate the pressure of the water emitted therefrom, whereby the force of the water emitted from said first means can be increased or decreased while at the same time the force of the water emitted from said second means is correspondingly increased or decreased whereby the speed of rotation of said rack can be controlled; and (e) a dosing means adapted to cooperate with said second spray jet means for dosing with soap water flowing through said second spray jet means.

7. A rotatable dishwasher as defined in claim 6 in which said second spray jet means comprises a non-rotatable hollow tubing having a first substantially horizontally extending leg portion extending beneath said rack, a substantially vertically extending leg disposed proximate the periphery of said rack and a second substantially horizontally extending leg portion disposed above said rack, said tubing being provided with a multiplicity of apertures located and arranged so that a multiplicity of fine jets of water will be simultaneously directed at said rack to sustain rotational movement thereof.

8. A rotatable dishwasher as defined in claim 7 which includes means for further controlling the speed of rotation of said rack said means including a bath of water carried by said floor of said housing in which said vanes are at least partially immersible thereby providing impedance to rotation of said rack.

9. A dishwasher adapted to be operated by interconnection with a domestic hot water supply, said dishwasher comprising:

(a) a housing;

(b) a rack rotatably mounted within said housing said rack being adapted to support articles to be washed and including a plurality of downwardly depending vanes;

(c) a first collimated jet means for directing a collimated stream of water from said domestic hot water supply at said vanes for imparting first rotational forces to said rack;

(d) a second spray jet means for directing a plurality of fine jets of water from said domestic hot water supply at said articles carried by said rack for imparting second rotational forces to said rack; and (e) control means for simultaneously regulating the flow of water between said first collimated jet means and said second spray jet means respectively, whereby said first rotational forces can be decreased while at the same time correspondingly increasing said second rotational forces.

10. A dishwasher as defined in claim 9 in which said second spray jet means comprises a non-rotatable conduit having a substantially vertically extending leg disposed proximate the periphery of said rack and a substantially horizontally extending leg disposed above said rack, said conduit being provided with a multiplicity of apertures located and arranged so that a multiplicity of fine jets of water will be simultaneously directed at said articles supported on said rack to sustain rotational movement of said rack.

11. A dishwasher as defined in claim 10 including means for imparting counter rotational forces to said rack counter to said first and second rotational forces to prevent rotation of said rack at high rates of speed.

12. A dishwasher adapted to be operated by interconnection with a domestic hot water supply, said dishwasher comprising:

(a) a generally cylindrically shaped housing;

(b) a rack rotatably mounted within said housing, said rack having a circular shaped floor and a plurality of support members adapted to support articles to be washed and including a plurality of circumferentially spaced apart vanes depending downwardly from said floor;

(c) a hollow housing having first and second water outlet ports and an inlet port interconnected with said supply of domestic hot water;

(d) a first collimated jet means operably connected with said first water outlet port of said hollow housing for directing a collimated stream of water at said vanes for imparting first rotational forces to said rack;

(e) a second spray jet means operably connected with said second water outlet port of said hollow housing for directing a plurality of fine jets of water at said articles carried by said rack for imparting second rotational forces to said rack, said second spray jet means comprising a non-rotatable conduit having a substantially vertically extending leg disposed proximate the periphery of said rack and a substantially horizontally extending leg disposed above said rack, said conduit being provided with a multiplicity of apertures located and arranged so that a multiplicity of fine jets of water will be simultaneously directed at said articles supported on said rack to sustain rotational movement of said rack; and (f) control means operably associated with said first water outlet port of said hollow housing for regulating the flow of water through said first port toward said first collimated jet means, whereby said first rotational forces imparted by said first jet means can be decreased while at the same time the flow of water through said second port is correspondingly increased thereby increasing said second rotational forces imparted by said second spray jet means.

* * * * *